United States Patent [19]

Haugaard

[11] Patent Number: 4,654,907

[45] Date of Patent: Apr. 7, 1987

[54] FOLDING RECREATION CHAIR-PAD

[76] Inventor: Bradley R. Haugaard, 2320 E. Oakdale St., Pasadena, Calif. 91107

[21] Appl. No.: 822,251

[22] Filed: Jan. 24, 1986

[51] Int. Cl.[4] ..... A47G 9/06

[52] U.S. Cl. ..... 5/420; 297/17; 297/377

[58] Field of Search ..... 297/17, 377, 382, 456; 5/419, 420, 432, 433, 465

[56] References Cited

U.S. PATENT DOCUMENTS

| | | | |
|---|---|---|---|
| 2,734,556 | 2/1956 | Hebrank | 297/382 |
| 2,857,957 | 10/1958 | Gay | 5/420 |
| 2,884,991 | 5/1959 | Bloomquist | 297/377 |
| 3,041,637 | 7/1962 | Emery | 5/433 |
| 3,143,748 | 8/1964 | Manning | 5/420 |
| 3,404,915 | 10/1968 | Filho | 297/17 |
| 3,627,086 | 12/1971 | Calgan | 297/17 |
| 3,659,297 | 5/1972 | Schutz | 5/465 |
| 3,902,759 | 9/1975 | Monteforte et al. | 5/465 |
| 4,459,714 | 7/1984 | Lin | 5/465 |

FOREIGN PATENT DOCUMENTS

| | | | |
|---|---|---|---|
| 28323 | 8/1931 | Australia | 5/419 |

*Primary Examiner*—Francis K. Zugel
*Attorney, Agent, or Firm*—J. L. Jones, Sr.

[57] ABSTRACT

A foldable, inexpensive, easily assembled recreation chair-pad combination can be folded into a compact manually carried luggage piece. Basically, an exterior, double folded cover is separately formed into three closed compartments and a cover extension. Each compartment is formed and separately secured by the three doubled cloth hinges, which are secured by securing means such as multiple grommets disposed and secured along the three hinge lines. A foam pad two inches thick by about 15×15 inch square is disposed and secured in one first end compartment. Similarly, a ¼ inch thick plywood backing sheet, and a 2 inch thick foam pad of equal area to the above are disposed in the two adjacent compartments. Velcro matching fastener strips are adaptively sized, placed and secured on the opposed sides of the cover, positioned to cohere to each other on folding the chair-pad into a multiple folded piece of luggage, folded at the three hinge lines. The chair-pad can be arranged and positioned into an A-frame structure in which the two plywood panels are structurally erected in two adjacent compartments directly facing each other, and a soft foam seat compartment rests on a canvas extension compartment. The body pressure of a human sitting on a soft foam seat anchors the A-frame chair pad in position. The chair-pad can also be folded out into a flat pad.

1 Claim, 4 Drawing Figures

FOLDING RECREATION CHAIR-PAD

BACKGROUND OF THE INVENTION

The folding recreation chair-pad of this invention is classified in class 5.

S. Lerman in U.S. Pat. No. 3,323,151 issued June 6, 1967, teaches and discloses a portable foldable pad with a self-contained hand-grip. The pad contains a foamed thermoplastic synthetic resin, such as polyvinyl chloride, polyurethane or the like resin of closed-cell internal structure. A seat-pad A and a set-pad B can be joined by a relatively wide hinge forming element 16, all formed by the synthetic resin.

Freedman in British Pat. No. 962,694 issued July 1, 1964 discloses an air bed or beach mattress that provides a reclining back or head support. A belt or girdle of webbing completely encircles the air bed or mattress and is secured thereto by an opposed pair of bolts which secure the belt and the air bed together. A pair of struts with bolts, enter the air bed at the girdle secured end and support the girdle end of the air bed.

Emery in U.S. Pat. No. 3,121,884 issued Feb. 25, 1964 discloses a back rest taught to be infinitely adjustable, triangular construction. The back rest has a normally back supporting mid-section, an end brace section and an end base section with resilient frictional holding loop means attached to one end of one of the end sections.

Emery in U.S. Pat. No. 3,041,637 July 3, 1962, discloses a back rest of one piece design providing a choice of several back rest positions, secured by several stops 26, 27 and 28, for the edge 25.

Blaschko in U.S. Pat. No. 2,966,205, issued Dec. 27, 1960 discloses a combined ottoman and collapsible back rest, having a top panel pivoted to the upper rear portion of the pair of side panels. Four panels, including the top panel, can be unfolded into a connected back rest operative position. The four panels are rigidly hinged and interconnected, and fold into an ottoman device.

Gay in U.S. Pat. No. 2,857,957 issued Oct. 28, 1958 discloses and claims a lounge device, whereby a user may comfortably lie or sit at ease with his back or head supported at one lounge end. A head support member 2 has a folding mattress composed of folding mattress connected sections 4, 5, 6 and 7.

Marotti, A. in Italian Pat. No. 585,747 issued Nov. 26, 1958, discloses and teaches a two cushion rest pad, having a pivotal support frame of metal disposed in one cushion, and a second cushion hingedly secured to the first cushion. The second cushion is the seat cushion.

Marz in German Pat. No. 949,771 issued September 1956, discloses a three cushion back rest, the seat pad 1, and two back pads 2 and 3. A rigid pivoting pair of exterior frame support pads 2 and 3 as triangular back rests.

Mendenhall in U.S. Pat. No. 1,404,461 issued Jan. 24, 1922, discloses a hinged two section back rest with a flexible back rest having wooden back slats and a canvas cloth seat section secured to the back rest.

SUMMARY OF THE INVENTION

An inexpensive, foldable, easily assembled recreation chair-pad combination has a cloth tubular folded cover, a first terminus, three adjacent hinged pad areas, together with a cloth cover extension and an adjacent second terminus. The chair-pad can be folded into a compact luggage piece at the three hinge areas which separate the three pad areas and the cloth extension. An exterior, double folded cloth cover is adaptively sized and sewn or secured into three compartments of approximately equal size, and a cloth cover extension of a required length. The cloth cover can be secured into the three compartments by sewn straight lines across the cover, or by cloth narrow hinge areas formed by multiple grommets secured through the opposed pair of cloth covers, disposed on straight hinge lines, forming a cloth tubular folded cover. The long chair-pad edge could be sewn shut.

Adjacent the first terminus of the chair-pad disposed in an unfolded pad position, the first compartment contains a foam pad unit about 15×15×2 inch thick. The adjacent second compartment is separated from the first compartment by a double cloth cover first hinge about 1.5 inch wide and extending the exterior double folded cover 15. inch width. The second compartment contains a 15×15×2 inch thick second foam pad, and a covering first plywood panel of equal area and about ¼ inch thick. A second cloth hinge about 1.5 inch wide also extends the full 15, inch width of the double folded cloth cover, formed by sewing or by multiple grommets.

Adjacent the second cloth hinge area there is disposed and secured a third compartment sized to contain a third foam pad, 15×15×2 inch thick and a covering second plywood panel of equal area and about ¼ inch thick. A third cloth hinge about 1.5 inch wide also extends the full 15 inch width of the double folded cloth cover, the hinge formed by a sewn sham or by multiple grommets, the third hinge secures and closes the third compartment.

A cloth cover extension begins at the third hinge and extends to the second pad terminus, the length of the cover extension being the required adaptively sized value. The cover extension can have a double folded cloth, or it can be cut to provide a single cloth layer, since no pad compartment is required to be provided. The cloth cover extension can have a pocket or plural pockets provided adjacent and inside the second pad terminus, by folding the cloth bath upon itself for the adaptively sized pockets and sewing or securing the single pocket or plural pockets in position.

A Velcro hook securing system is adaptively secured and positioned on the cloth face of the third compartment adjacent the plywood panel contained in the third compartment, and on a mating position on a reverse side of the cloth extension. The Velcro system can have mating confronting grips of the opposed Velcro strips. A handle is also secured to the cloth extension, the handle being positioned for manually carrying the folded compartmented luggage, when the Velcro fasteners are guided into mating positions and the opposed Velcro strips are mated.

The recreation chair-pad can be folded out into a flat cushioned pad, with the second and third compartment plywood panels disposed directly adjacent the ground or sandy beach. The human user can rest on the plastic cushions covered with cloth.

The recreation chair-pad can also be used as a chair providing back support to a human user. The back support is provided by folding the second and third padded compartments into an A-frame, at the second cloth hinge, the first and second plywood panels directly confronting each other. The first pad compartment is folded at the first cloth hinge and laid directly on the cloth extension. When the human user sits on the first pad compartment, the weight by the human user secures the first pad compartment in position and locks the folded A-frame in a supporting position for the human user's back.

Although the above exposition relates to a chair-pad for one human user, the chair-pad can be manufactured in a double, triple, or quadruple widths for 2, 3 or 4 human users together on the one chair-pad, by manufacturing the chair-pad in multiples of 1.5 inch or the like.

Included in the objects of this invention are:

To provide a reclining beach chair which can be used simultaneously by one, two, three or four human users, side by side.

To provide a folding recreation chair-pad which can provide a flat recreational pad for beach sand, field or lawn.

To provide a recreation chair-pad which can be folded into a compact luggage piece which can be carried as a piece of baggage.

To provide a reclining beach chair-pad suitable for folding into a flat recreational pad.

Other objects and advantages of this invention are taught in the following description and claims.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
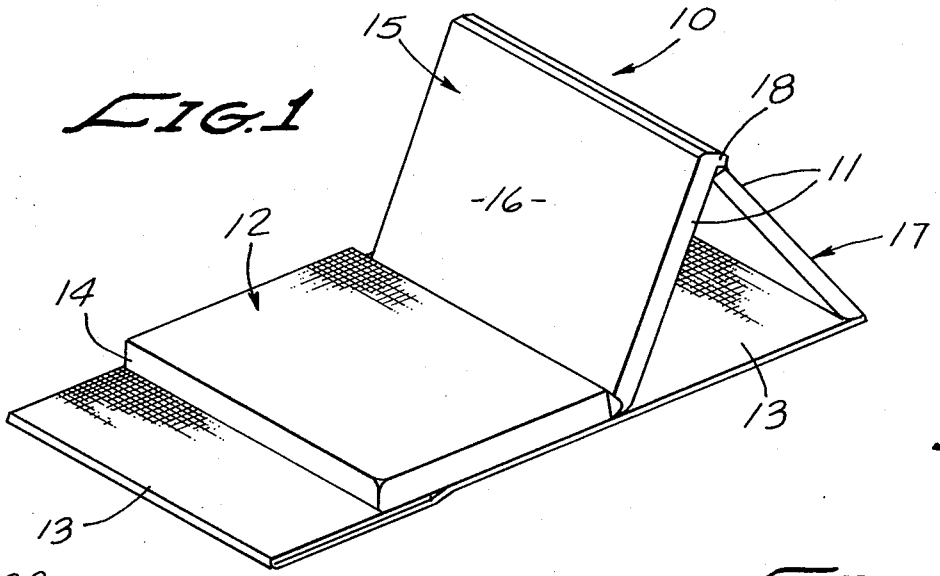
FIG. 1 is an isometric projection view of the recreation chair-pad of this invention, adaptively disposed in an A-frame position, providing a back support for a reclining human form.

Referring to FIG. 1 in detail, there is illustrated an isometric view of the folding recreation chair-pad combination 10 of this invention, disposed in an A-frame structure 11 suitable for supporting the back of a human who could be resting on the first pad compartment 12. The first compartment 12 could be frictionally secured onto the cloth cover extension 13 by the weight of a human body resting on compartment 12. The first terminus 14 of the chair-pad combination 10 is shown disposed on the cloth cover extension 13. The second pad compartment 15 is shown adjacent to the first pad compartment 12, a specific upper padded face 16 of compartment 15 being disposed upward. The third pad compartment 17 is shown disposed and supporting the compartment 15 at the linear stop 18. Two ¼ inch thick plywood panels 15×15 inch in area are disposed (unseen) as load supporting members in the second pad compartment 15 and the third pad compartment 17 disposed in the A-frame structure 11, the wood plywood panels confronting each other on the inside of the A-frame structure 11. A large single pocket or a pair of smaller cloth pockets 19 are shown adjacent to the chair-pad compartment 12 shown disposed on the cloth extension 13.

Figure 2:
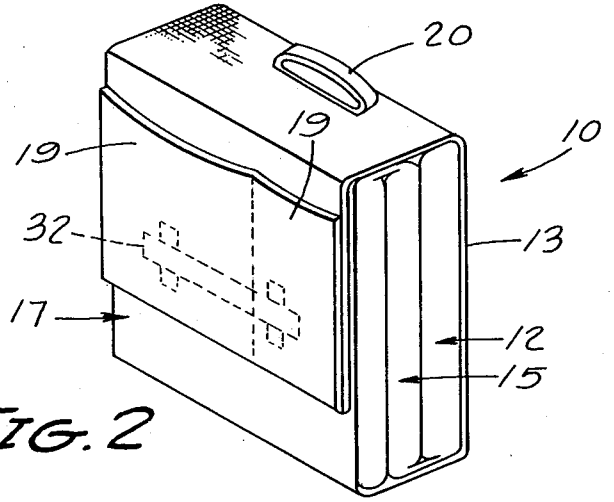
FIG. 2 is a isometric projection view of the recreation chair-pad folded up into a compact luggage piece suitable for manual carrying.

Referring to FIG. 2 in detail, the chair-pad combination 10 is shown folded into a compact luggage piece, with a handle 20 of cloth, leather or the like, for manual carriage of the combination 10. Typically, the first pad compartment 12 is disposed adjacent to the cloth extension 13, and the two pad compartments 15 and 17 are folded adjacently. The handle 20 permits the chair-pad combination 10 to be carried as a piece of luggage.

Figure 3:
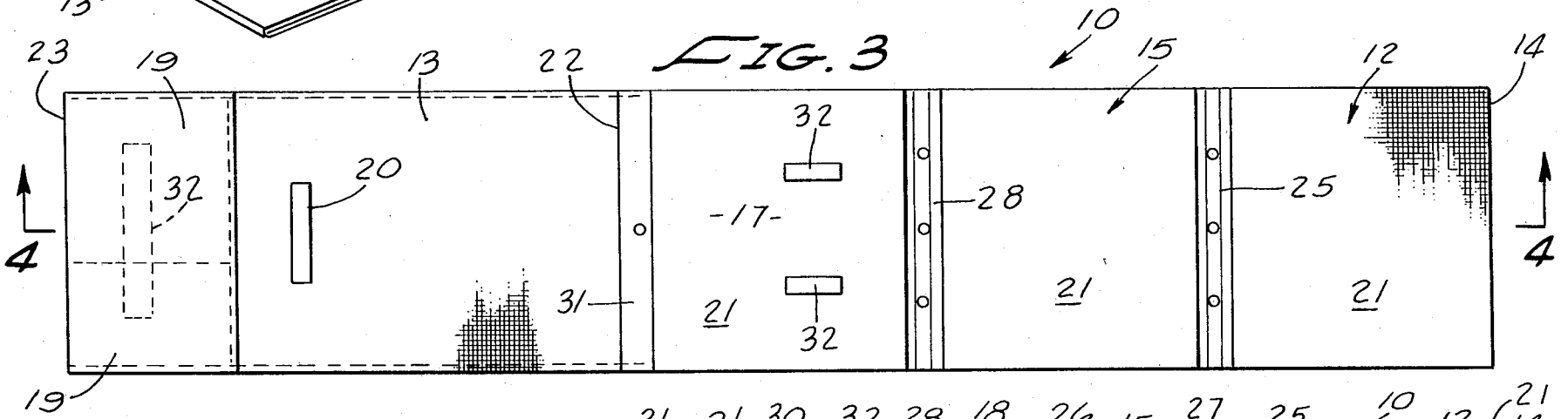
FIG. 3 is a plan view of the recreation chair-pad, unfolded into its full plan view as a pad.
Figure 4:
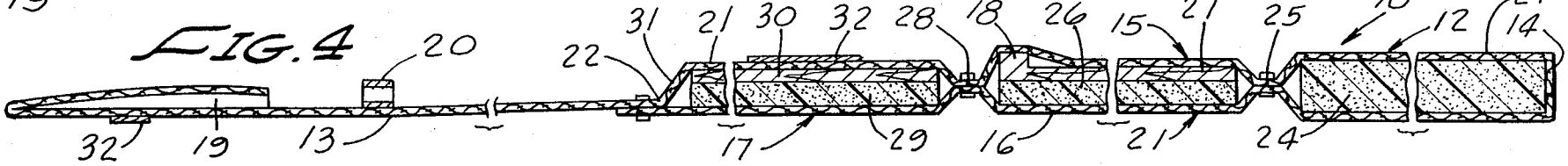
FIG. 4 is a cross sectional view through 4—4 of FIG. 3.

Combining the illustrations of FIGS. 3 and 4, the chair-pad combination 10 is shown in a lay-flat position in FIG. 3 wherein the chair-pad 10 has first terminus 14, a tubular cloth cover 21 extending from 14 to at least the pad hinge terminus 22. The cloth extension 13 extends from terminus 22 to the second chair-pad terminus 23, and 13 can be a single layer of cloth or a tubular double layer of cloth. The tubular layer of cloth 21, extending from 14 to 22, includes a pad compartment 12 containing a foam pad 24 of 15×15 inch area and 2 inch thickness which is adaptively disposed and secured within compartment 12. A first cloth hinge area 25 approximately 15. inch long and 1.5 inch wide is disposed between the first pad compartment 12 and the second pad compartment 15. The first cloth hinge area 25 can be secured and delineated by cloth sewing lines or by plural grommet lines formed across the 15 inch long hinge area 25. The second pad compartment 15 contains a porous foam pad 26 of dimensions 15×15×2 inch thickness which is adaptively disposed in compartment 15, and which has a 15×15×¼ inch thick plywood board 27 disposed on top of the pad 26. The second cloth hinge area 28, approximately 15. inch long by 1.5 inch wide is secured and delineated by sewn cloth lines or by plural grommet lines disposed across the 15 inch wide hinge 28. The third pad compartment 17 also has construction components in tubular cloth cover 21 similar to the second pad compartment 15, having a 2 inch thick porous foam pad 29 disposed therein and a ¼ inch thick plywood panel board 30, both of 15×15 inch area. The third cloth hinge 31 seals compartment 17, delineated by sewn line across the approximately 15 inch long, or plural grommets binding the two faces of the tubular cover 21.

The cloth extension 13 can consist of the full double cloth cover 21, or the extension starting at the extension hinge terminus 22 to the second chair-pad combination terminus 23 can be formed of a single layer of the cloth of tubular cloth cover 21. A deep pocket or plural pockets 32 can be formed and sewn into shape, by doubling back a length of extension cloth cover 21.

On the cloth extension 13 whose side is opposed to the pockets 32, strips of Velcro tape can be positioned and secured. Matching Velcro strips can be disposed and secured on the pad compartment 17, on the cloth cover 21, adjacent the plywood panel 30. The confronting Velcro strips are mated on the folding chair-pad combination 10 into a luggage piece of FIG. 2. The overall length of the chair-pad combination 10 can be 84 inches or more. Although the width of the combination 10 is given as 15 inch width for a single human user, the combination 10 can be provided in multiples of 15 inches for 2, 3 and 4 human users. Other basic width dimension can be used than 15 inches, for example, 18 or 20 inch. The side seam of a tubular cloth cover 21 can be sewn in one complete length, the compartments 12, 15 and 17 filled, and hinges 25, 28, 31 completed in sequence. The first terminus 14 can be completed by a sewn line.

Many modifications in the chair-pad combination can be made in the light of my teachings. It is understood that within the scope of the claims, the invention can be practiced otherwise than as described.

I claim:

1. A folding, recreation chair-pad combination comprising: an exterior double folded tubular exterior cloth cover, having the confronting tubular cover two edges secured together and also having the confronting two edges of said tubular folded exterior cover first terminus secured together, a first compartment having said one double tubular folded exterior cloth cover edge first terminus, having said confronting tubular cover two secured edges, and having a first cloth hinge area adaptively secured and delineated by a cloth sewing line, said first compartment containing a conforming sized first foam pad, a second compartment formed by said one double tubular folded exterior cloth cover two secured edges, said first cloth hinge area, said second compartment containing a conforming sized second foam pad and a first thin plywood board equivalent to the size of the second foam pad, said second compartment having a second cloth hinge area adaptively sized and delineated by a cloth sewn securing line, a third compartment formed by said one double tubular folded exterior cloth cover two secured edges, said second cloth hinge area, said third compartment containing a conforming sized third foam pad and a second thin plywood board equivalent to the size of said third foam pad, said third compartment having a third cloth hinge area adaptively sized and delineated by a cloth sewing line, said secured plywood board coadjacently opposed and confronting said first plywood board in said second compartment, and, a tubular cloth extension extending from said third hinge area to said second cover terminus, a pair of opposed hook forming pile thread fastener tape sets each adaptively spaced and secured on opposed faces of said tubular folded exterior cloth cover, one said hook fastener tape secured on said third compartment cover adjacent said plywood board, and one opposed said hook fastener tape disposed and secured on the second opposed face of said exterior cover of said extension cover, said opposed tape fasteners adaptively spaced to mate when said first, second and third compartments are folded at said first, second and third hinge areas, and covered by said tubular cloth extension, a luggage handle adaptively secured and disposed on said tubular cloth extension, providing a handle for said chair-pad combination folded as a piece of luggage, and, a linear wood stop adaptively sized and secured on the edge of the first plywood panel adjacent said second hinge area, providing a stop for said second plywood panel.

* * * * *